US007374622B2

(12) United States Patent
Zboril et al.

(10) Patent No.: US 7,374,622 B2
(45) Date of Patent: May 20, 2008

(54) BAINITIC STEEL ALLOY

(76) Inventors: Josef Zboril, Havlickova 590, Kostelec na Hane (CZ) 798 41; Eva Schmidova, Travnik 2000, Ceska Trebova (CZ) 560 02

( * ) Notice: Subject to any disclaimer, the term of this patent is extended or adjusted under 35 U.S.C. 154(b) by 0 days.

(21) Appl. No.: 11/158,536

(22) Filed: Jun. 21, 2005

(65) Prior Publication Data

US 2005/0279428 A1 Dec. 22, 2005

(30) Foreign Application Priority Data

Jun. 22, 2004 (CZ) ..... PUV 2004-15579

(51) Int. Cl.
*C22C 38/44* (2006.01)
*C21D 9/04* (2006.01)

(52) U.S. Cl. ..... 148/335; 148/581; 420/108

(58) Field of Classification Search ..... 148/335, 148/581; 420/108, 106
See application file for complete search history.

(56) References Cited

U.S. PATENT DOCUMENTS 5,382,307 A * 1/1995 Kageyama et al. ..... 148/584
5,759,299 A * 6/1998 Yokoyama et al. ..... 148/333
5,879,474 A * 3/1999 Bhadeshia et al. ..... 148/333
6,254,696 B1 * 7/2001 Ueda et al. ..... 148/333

* cited by examiner

*Primary Examiner*—Harry D. Wilkins, III
*Assistant Examiner*—Nicholas A. Smith
(74) *Attorney, Agent, or Firm*—Francis Law Group

(57) ABSTRACT

The invention comprises a structural member formed from iron alloyed with 0.15% to 0.20% carbon, 1.00% to 1.80% manganese, 1.00% to 1.60% silicon, 1.50% to 2.50% chromium, 2.50% to 3.50% nickel, 0.40% to 0.70% molybdenum and 0.0025% to 0.0005% boron, all by weight. Preferably, alloy is subjected to a two-level thermal processing to confer a bainitic structure to the steel. Also preferably, the structural member is a frog for a railway track switch.

2 Claims, No Drawings

BAINITIC STEEL ALLOY

CROSS-REFERENCE TO RELATED APPLICATIONS

This application claims priority based on Czech Republic Utility Model Application No. PUV 2004-15579, filed Jun. 22, 2004.

FIELD OF THE PRESENT INVENTION

The present invention relates generally to steel alloys for structural applications that have enhanced strength and wear resistance. More particularly, the invention is a structural member formed from bainitic steel alloy suitable for railway applications.

BACKGROUND OF THE INVENTION

Steel is a high strength material having versatile fabrication capabilities. A wide variety of alloys and processing conditions also allow the properties of steel materials to be optimized for its intended application. These characteristics make steel an excellent choice for a numerous structural applications.

For example, railways and tramways make extensive use of steel materials in the rail systems. Although many advantages are realized by using steel rails, these structures are subjected to significant stresses and failure can result. Further, as ever increasing weights are being freighted at higher speeds and greater frequency, there is an ongoing demand for steel materials having improved properties.

One structural member that experiences particularly high, repetitive stress is the frog, the intersecting point of a railway switch that allows the flanges of wheels moving along one of the rails to pass across the other. The frog supports the wheels over the missing tread surface between the frog throat and the frog point and provides flangeways for aligning the wheels when passing over the switch so that maximum bearing area is preserved. As can be appreciated, these structures are subject to high operational and axial loads and must be very reliable and resistant to failure. Thus, many attempts have been made to produce steel materials that increase the strength and reliability of frogs.

One steel conventionally used to cast frogs is a pearlitic steel, which is known under the tradename UIC 900A. This steel is iron alloyed with 0.60% to 0.80% carbon, up to 0.5% silicon, 0.80% to 1.3% manganese, up to 0.04% phosphor and up to 0.04% sulfur, all by weight. However, this material exhibits relatively low strength and wear resistance and suffers from a short service life. In particular, this steel is subject to the development of blanks, has low notch toughness and susceptible to fracture.

Another prior art material is an austenitic steel, which is known under the tradename 13Mn Super Special. This steel is iron alloyed with 0.60% to 0.80% carbon, 12.50% to 16.50% manganese, up to 0.6% silicon, up to 0.05% phosphor, up to 0.03% sulfur, and 1.80% to 2.20% molybdenum, all by weight. Although this steel offers increased strength, as compared to UIC 900A, its composition makes welding operations with high carbon steels very difficult.

Further, the protocols for ultrasound imaging fault analysis of this material differ from other steels. As a result, the maintenance costs associated with this material are significantly increased. Although improved, the wear resistance of 13Mn Super Special has not been found sufficient to justify the increased maintenance costs.

Yet another prior art steel is known under the tradename Lo8CrNiMo. This alloy comprises 0.11% to 0.15% carbon, 0.50% to 0.80% manganese, up to 0.50% silicon, 1.60% to 2.00% chromium, 2.60% to 3.00% nickel, 0.40% to 0.50% molybdenum, up to 0.003% boron, up to 0.045% aluminum, up to 0.13% vanadium, up to 0.05% titanium, up to 0.012% nitrogen, up to 0.015% phosphor, and up to 0.012% sulfur, all by weight. This steel has improved wear resistance, but is relatively low in strength, and thus is limited to situations where the average operational load is up to 22.5 MT per axle.

It is therefore an object of the present invention to provide a structural member formed from steel alloy having improved strength, wear resistance, weldability and operational service life.

It is a further object of the invention to provide a chrome-nickel-molybdenum steel suitable for frogs.

It is yet another object of the invention to provide a bainitic steel for use with railway and tramway structural members.

SUMMARY OF THE INVENTION

In accordance with the above objects and those that will be mentioned and will become apparent below, the structural member of the invention comprises in the range of approximately 0.15% to 0.20% carbon, in the range of approximately 1.00% to 1.80% manganese, in the range of approximately 1.00% to 1.60% silicon, in the range of approximately 1.50% to 2.50% chromium, in the range of approximately 2.50% to 3.50% nickel, in the range of approximately 0.40% to 0.70% molybdenum and in the range of approximately 0.0025% to 0.0005% boron, all by weight, with the balance comprising iron.

In one embodiment of the invention, the steel has a yield point of at least approximately 1100 MPa. In the noted embodiment, the steel preferably has a tensile strength of least approximately 1400 MPa. Also preferably, the peak load is at least approximately 20 J. Further, the fracture toughness is preferably at least approximately 100 MPa$\sqrt{m}$.

In one embodiment of the invention, the structural member is formed by heat treatment. Preferably, the heat treatment comprises austempering to impart a bainitic structure to the steel. More preferably, alloy is subjected to a two-level thermal process.

The invention also includes methods of making structural members, such as frogs. The methods general include the steps of alloying iron with carbon in the range of approximately 0.15% to 0.20%, manganese in the range of approximately 1.00% to 1.80%, silicon in the range of approximately 1.00% to 1.60%, chromium in the range of approximately 1.50% to 2.50%, nickel in the range of approximately 2.50% to 3.50%, molybdenum in the range of approximately 0.40% to 0.70% and boron in the range of approximately 0.0025% to 0.0005%, all by weight, casting the structural member and heat treating the structural member. Preferably, the heat treatment comprises an austempering process that imparts a bainitic structure to the structural member.

DETAILED DESCRIPTION OF THE INVENTION

Before describing the present invention in detail, it is to be understood that this invention is not limited to particularly exemplified apparatus, systems, structures or methods as such may, of course, vary. Thus, although a number of apparatus, systems and methods similar or equivalent to those described herein can be used in the practice of the present invention, the preferred materials and methods are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Finally, as used in this specification and the appended claims, the singular forms "a, "an" and "the" include plural referents unless the content clearly dictates otherwise.

The present invention comprises a structural member formed from a steel alloy, particularly suitable for railway and tramway structural members such as a frog, that comprises in the range of approximately 0.15% to 0.20% carbon, in the range of approximately 1.00% to 1.80% manganese, in the range of approximately 1.00% to 1.60% silicon, in the range of approximately 1.50% to 2.50% chromium, in the range of approximately 2.50% to 3.50% nickel, in the range of approximately 0.40% to 0.70% molybdenum and in the range of approximately 0.0025% to 0.0005% boron, all by weight, with the balance comprising iron. Preferably, the alloy of the invention is subjected to a two-level thermal processing to confer a bainitic structure to the steel.

The bainitic structures of the invention are formed at temperatures below the high temperature reactions that produce ferrite or pearlite structures and above the low temperature reactions that produce martensite structures. Generally, bainite is formed at temperatures in the range of approximately 250 to 550° C. Further, bainite forms when steel is cooled at a rate too rapid for the formation of pearlite and too slow for the formation of martensite.

Steel having a bainitic structure is preferably formed by austempering. The alloy is first heated to a temperature at which the steel changes to the austenite phase. The steel is then rapidly quenched and held at a temperature below the pearlite formation range and above the martensite formation range. The steel then is allowed to convert to the bainitic structure isothermally. Finally, the steel is quenched to room temperature to complete the process. The noted process increases the ductility and notch toughness of the steel while maintaining high hardness levels. These attributes contribute to the wear resistance of the material and improve its service life.

As one having ordinary skill in the art will recognize, each element alloyed with the iron contributes to various characteristics of the resulting material and/or affects the formation of bainitic structure. Carbon, silicon and chromium all contribute to the strength of the steel, contributing to the formation of carbides dispersed within the bainitic structure. Magnanese also increases the hardness of the carbides while lowering the bainite transformation temperature. Molybdenum, copper and boron increase strength, while nickel, titanium and magnesium increase ductility and toughness. Further, molybdenum improves weldability. Accordingly, the amount and use of these alloying elements can be readily tailored to optimize the characteristics of the steel depending upon the desired application.

In one embodiment of the invention, the steel has a yield strength, or yield point, of at least approximately 1100 MPa. In the noted embodiment, the steel preferably has a tensile strength, or strength limit, of least approximately 1400 MPa. Also preferably, the peak load is at least approximately 20 J. Further, the fracture toughness is preferably at least approximately 100 $MPa\sqrt{m}$.

EXAMPLES

Sample 1

A steel alloy was prepared, containing by weight 0.19% carbon, 1.10% manganese, 1.06% silicon, 0.020% phosphor, 0.010% sulfur, 1.97% chromium, 2.96% nickel, 0.03% titanium, 0.47% molybdenum and 0.0031% boron, with the balance comprising iron. The alloy was subjected to heat processing as described above to impart a bainitic structure. This alloy was then tested and found to have a yield strength of 1245 MPa, a tensile strength of 1521 MPa, a peak load of 24.3 J and a fracture toughness of 108.4 $MPa\sqrt{m}$.

Sample 2

A steel alloy was prepared, containing by weight 0.20% carbon, 1.54% manganese, 1.06% silicon, 0.020% phosphor, 0.010% sulfur, 2.02% chromium, 2.99% nickel, 0.02% titanium, 0.49% molybdenum, 0.0026% boron and 0.04% aluminum, with the balance comprising iron. The alloy was subjected to heat processing as described above to impart a bainitic structure. This alloy was then tested and found to have a yield strength of 1169 MPa, a tensile strength of 1420 MPa, a peak load of 29.3 J and a fracture toughness of 110.2 $MPa\sqrt{m}$.

Sample 3

A steel alloy was prepared, containing by weight 0.164% carbon, 1.65% manganese, 1.207% silicon, 0.013% phosphor, 0.010% sulfur, 1.71% chromium, 2.89% nickel, 0.0376% titanium, 0.479% molybdenum, 0.0036% boron and 0.015% aluminum, with the balance comprising iron. The alloy was subjected to heat processing as described above to impart a bainitic structure. This alloy was then tested and found to have a yield strength of 1147 MPa, a tensile strength of 1457 MPa, a peak load of 21.3 J and a fracture toughness of 111.2 $MPa\sqrt{m}$.

Thus, the structural members formed from steel alloys of the invention have improved strength and toughness, allowing them to perform at higher operational loads. The inventive structural members also have improved service life while having good weldability, facilitating maintenance. For example, a frog for a railway track switch formed from the alloys of the invention has improved strength and reliability and is capable of operating at higher operational loads, including both increased per axle loads and increased loads passed in a given time period.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

What is claimed is:

1. A method for making a structural member, consisting of the steps of: alloying iron with carbon in the range of approximately 0.15-0.20 wt. %, manganese in the range of approximately 1.00-1.80 wt. %, silicon in the range of approximately 1.00-1.60 wt. %, chromium in the range of approximately 1.50-2.50 wt. %, nickel in the range of approximately 2.50-3.50 wt. %, molybdenum in the range of approximately 0.40-0.70 wt. % and boron in the range of approximately 0.0025-0.005 wt. %; casting said structural member; and austempering said structural member to impart a bainitic structure in said structural member, said austempering step consisting of heating said casting to a first temperature, whereby said casting exhibits an austenite phase, rapidly quenching said casting to a second temperature below the pearlite formation range and above the martensite formation range, maintaining said casting at said second temperature until said casting exhibits said bainitic structure, and subsequently quenching said casting to room temperature; wherein said structural member has a resulting fracture toughness of at least approximately 100 $MPa\sqrt{m}$.

2. The method of claim 1, wherein said structural member comprises a frog.

* * * * *